United States Patent [19]

Albrecht et al.

[11] 4,416,706

[45] Nov. 22, 1983

[54] PROCESS TO PRODUCE AND STABILIZE A REVERSIBLE TWO-WAY SHAPE MEMORY EFFECT IN A CU-AL-NI OR A CU-AL ALLOY

[75] Inventors: Joachim Albrecht, Mülligen; Thomas Duerig, Nussbaumen; Olivier Mercier, Ennetbaden; Walter Weber, Zurich, all of Switzerland

[73] Assignee: BBC Brown, Boveri & Company Limited, Baden, Switzerland

[21] Appl. No.: 403,129

[22] Filed: Jul. 29, 1982

[30] Foreign Application Priority Data

Feb. 5, 1982 [CH] Switzerland ..... 707/82

[51] Int. Cl.[3] ..... C21D 8/00

[52] U.S. Cl. ..... 148/11.5 C; 148/402

[58] Field of Search ..... 428/960; 148/11.5 C, 148/415, 416, 402

[56] References Cited

U.S. PATENT DOCUMENTS 4,019,925 4/1977 Nenno et al. ..... 428/960

FOREIGN PATENT DOCUMENTS 606894 5/1978 U.S.S.R. ..... 428/960

*Primary Examiner*—M. J. Andrews
*Assistant Examiner*—Debbie Yee
*Attorney, Agent, or Firm*—Oblon, Fisher, Spivak, McClelland & Maier

[57] ABSTRACT

Process to produce a reversible two-way shape memory effect in Cu-Al-Ni and Cu-Al memory alloys by heat treating said alloy while applying an external lead (G) after the martensite formation accomplished by the conventional steps: solution treatment, quench (1,2) and deformation (3). Additional improvements by optional Martensite Stabilization (10) and Two-way Effect Zero-point Stabilization (12) in the form of further heat treatments.

3 Claims, 4 Drawing Figures

PROCESS TO PRODUCE AND STABILIZE A REVERSIBLE TWO-WAY SHAPE MEMORY EFFECT IN A CU-AL-NI OR A CU-AL ALLOY

This invention concerns a process to produce and stabilize a two-way shape memory effect in a Cu-Al-Ni or Cu-Al alloy.

With memory alloys in general, the difference between the so-called two-way effect and the one-way effect must be distinguished. While the latter is generally more pronounced, better known (e.g. - Ni-Ti and the $\beta$-brasses) and has led to numerous applications, the two-way effect is more problematic and difficult to control. There is, however, a common technological demand for components which show a two-way effect of sufficient magnitude to open further interesting fields of application. Usually the temperature of the martensitic transformation in the classical two-way shape memory alloys falls into an undesirable temperature range. There are, however, a number of shape memory alloys, especially the $\beta$-brasses such as the classical Cu-Al-Ni and Cu-Al alloys, which have a suitable transformation temperature; these alloys have a remarkable one-way effect, but a negligible two-way effect.

The following documents can be quoted as "state of the art":

R. Haynes, Some Observations on Isothermal Transformations of Eutectoid Aluminium Bronzes Below their $M_S$—Temperatures, Journal of the Institute of Metals 1954–1955, Vol. 83, Pages 357–358; W. A. Rachinger, A "Super Elastic" Single Crystal Calibration Bar, British Jounral of Applied Physics, Vol. 9, June 1958, pages 250–252; R. P. Jewett, D. J. Mack, Further Investigation of Cu-Al Alloys in the Temperature Range Below the $\beta$ to $\alpha+\gamma_2$ Eutectoid, Journal of the Institute of Metals, 1963–1964, Vol. 92, pages 59–61; K. Otsuka and K. Shimizu, Memory Effect and Thermoelastic Martensite Transformation in Cu-Al-Ni Alloy, Scripta Metallurgica, Vol. 4, 1970, pages 469–472; K. Otsuka, Origin of Memory Effect in Cu-Al-Ni Alloy, Japanese Journal of Applied Physics, Vol. 10, no. 5. May 1971, pages 571–579.

There is, therefore, a demand for components made from shape memory alloys of the $\beta$-brass type, which have a transformation temperature suitable for certain specific applications, while exhibiting a noticeable two-way effect. The purpose of this invention is to provide a process by which a considerable reversible two-way effect can be induced in Cu-Al-Ni and Cu-Al alloys, and to stabilize this effect (if necessary) so that components can be produced from said alloys which are then suitable for practical applications.

This goal is achieved by the features indicated in claim 1 and, in addition, in a preferred manner by the features indicated in claim 2.

The invention will be described in the following working examples and illustrated in attached diagrams.

Figure 1:
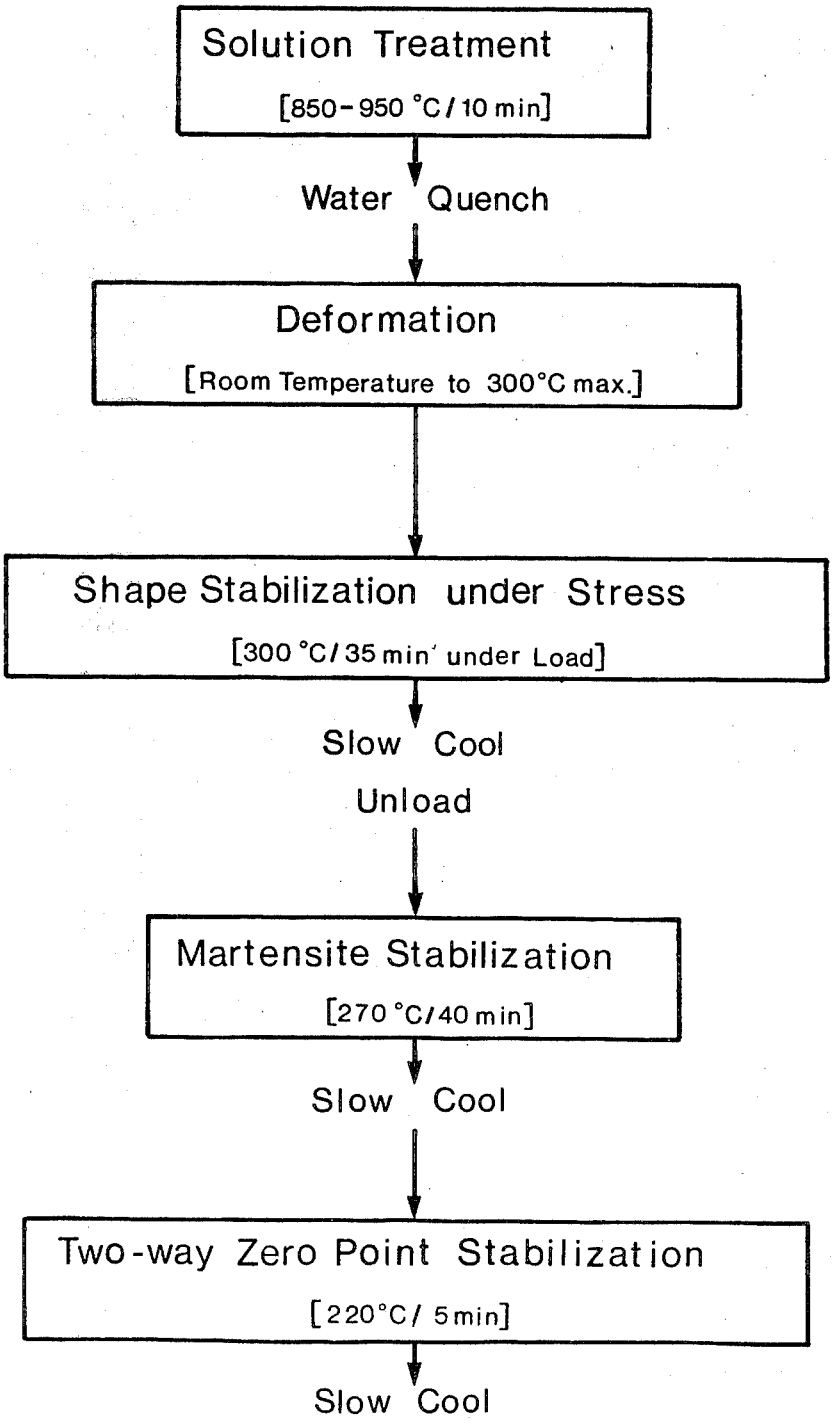

The figures show:

FIG. 1 - A flow chart of the process.

Figure 2:
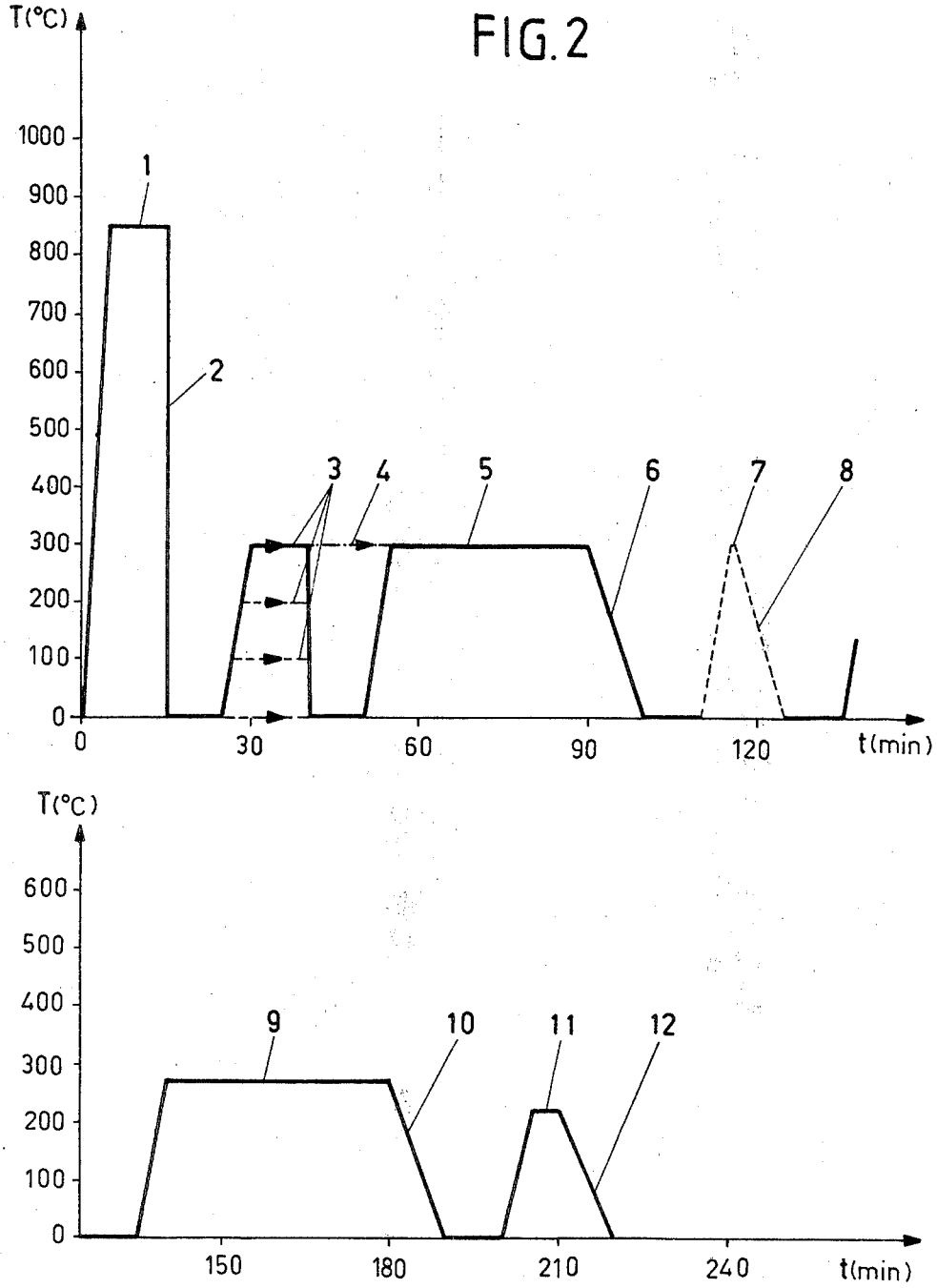

FIG. 2 - A time-temperature diagram illustrating the individual steps of the process.

Figure 3:
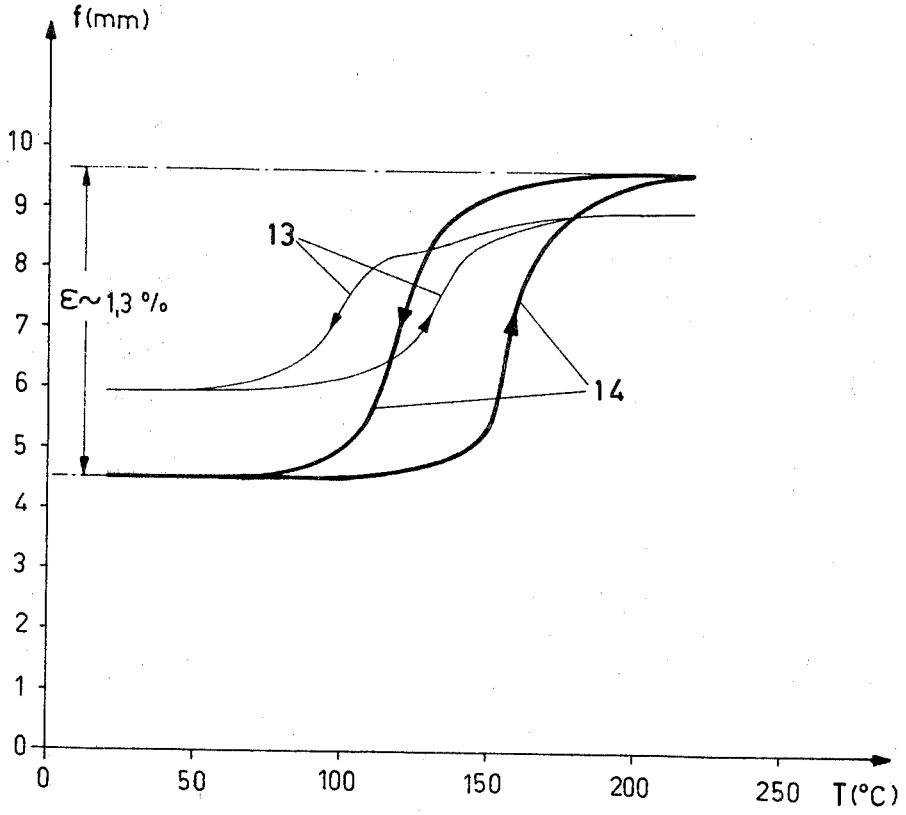

FIG. 3 - A diagram of the two-way effect in a bending element.

Figure 4:
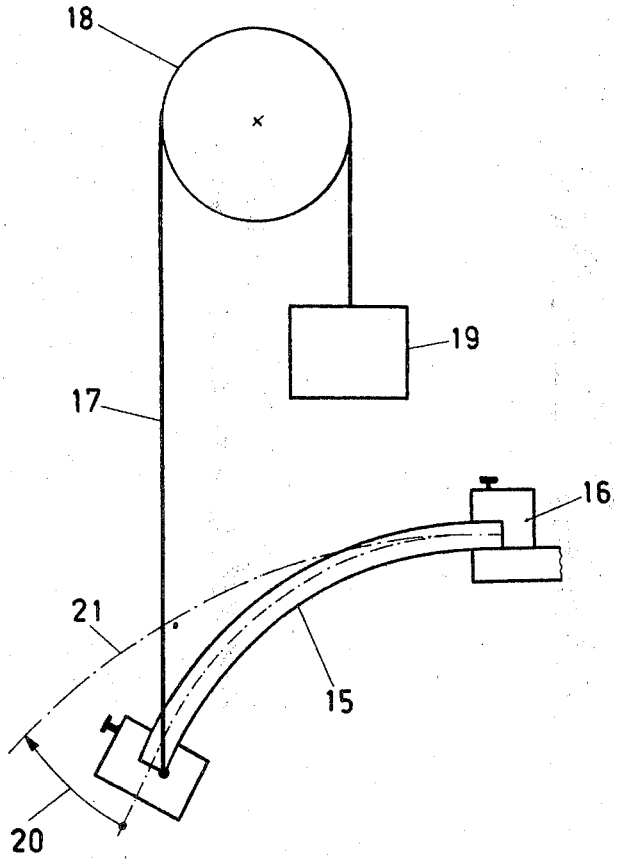

FIG. 4 - A schematic diagram for the apparatus used to measure the two-way effect in bending elements.

FIG. 1 shows a flow chart with the individual steps of the process in form of a block diagram. The critical thermomechanical or heat treatments respectively are emphasized by boxes. The rest of the diagram is self-explanatory.

FIG. 2 shows a time-temperature diagram illustrating the sequence of the individual processing steps according to the flow diagram in FIG. 1.

Step 1 represents the normal treatment, usually done at about 850° C., in order to transform the alloy into the structure of the $\beta$-solid solution. Step 2 is the subsequent water quench to retain the metastable condition at room temperature. Step 3 is the critical deformation step necessary to build up the memory effect and to shape the element; this deformation is done at room temperature or, in principle, at any temperature below 300° C. After this deformation, the work piece must be unloaded. In the case of deformation above room temperature, the element is quenched according to Step 4. Step 5 indicates a Shape Stabilization Treatment which has to be done in the temperature range of 150°–425° C. (here 300° C.) under stress, i.e.- under simultaneous application of a load. The work piece can then be slowly cooled 6. Alternatively, the condition after Step 6 can be reached more directly from Step 3 via Step 5 (holding at temperature). Steps 7 and 8 represent the following optional one-way effect treatment with subsequent slow cooling. These steps can, however, be omitted. An additional advantageous Martensite Stabilization Treatment followed by slow cooling is shown in Steps 9 and 10. The treatment is concluded by an optional but advantageous Two-way Zero-point Stabilization Treatment according to Step 11, and slow cooling (Step 12).

FIG. 3 shows a diagram of the two-way effect exemplified by a bending element. The movement (deflection f in mm) is expressed as a function of temperature T (in °C.). On cycling through a temperature range between about room temperature and 200° C., a reversible deflection is obtained as shown by the hysteresis curve. Curve 13 represents the effect without Martensite Stabilization, and Curve 14 with Martensite Stabilization. The quantitative improvement due to the Martensite Stabilization Treatment can be clearly seen. The maximum deflection difference of about 5 mm between the high and low temperature phases represents, in this case, an outer fiber strain of approximately 1.3%.

FIG. 4 schematically shows an apparatus for testing bending elements. The bending shape memory element is labeled 15. The gripping fixture for the element, or the so-called fixed point, is labeled 16. A wire (labeled 17) is led over a pully wheel (labeled 18), and counterweighted by a small load (labeled 19). This wire (17) is fixed to the moving end of the shape memory element. The counterweight (19) is chosen so that it is just sufficient to compensate for the frictional losses of the system during movement. The arrow indicates the direction of deflection in the bending element (15), which at full deflection reaches a position indicated by 22. The movements are recorded by a transducer (not shown) coupled to the pully (18).

Working Example I:

For producing and measuring a two-way shape memory effect, a bending element of the following composition was used:

Al: 14.2 wt. %
Ni: 3.2 wt. %
Cu: balance

The element had a square cross-section of 2.5 mm by 2.5 mm and a length of 35 mm. It was treated in a fashion similar to the process shown in FIGS. 1 and 2. First the element was preformed (prebent) at a temperature of 900° C. to a semi-circular shape with an inner radius of −37 mm (a negative radius indicating a curvature opposite to that of the subsequent cold deformation). Then the prebent element was solution treated for 15 minutes at a temperature of 950° C., and subsequently quenched in ice water (similar to Steps 1 and 2 in FIG. 2). Then the element was bent at room temperature in the opposite direction, to a radius of +35 mm (representing a strain on the element surfaces of 6.88%), similar to Step 3 in FIG. 2. Following this, the element was subjected to a Shape Stabilization Treatment, consisting of maintaining the element under stress for 30 minutes at 300° C., so that the radius of +35 mm was kept constant by the fixtures (similar to Step 6 in FIG. 2). After slowly cooling, the bending element was released from the extant load. Finally, the element was subjected to a Martensite Stabilization Treatment at 300° C. for 30 minutes (similar to Step 10 in FIG. 2). After slowly cooling to room temperature, the element was tested in the apparatus shown in FIG. 4. Curve 14 in FIG. 3 typifies the shape memory behavior of elements treated in the above fashion. The average maximum deflection during one heating cycle, as measured in several such specimens, varied between 4.4 mm and 5.9 mm, representing a range of strains between 1.15% and 1.53%; the average deflection was 4.94 mm, or 1.28% strain. The lower transformation temperature averaged 160° C., while the upper averaged 177° C. The width of the hysteresis loop was typically 17° C.

Working Example II:

A test element with the same dimensions and composition as that of Example I was solution treated at 850° C. for 10 minutes in an unbent condition, and subsequently quenched in cold water. Then the element was bent at room temperature to a radius of 22 mm, corresponding to an inner fiber strain of 5.4%. The bent element was subsequently held under load at a temperature of 300° C. for 30 minutes. The load was released while the element was still hot, unloaded, and then slowly cooled to room temperature. It was then tested in the same way as described in Example 1. Elements made without Martensite Stabilization showed a smaller two way effect and a large scatter in deflection, varying between 2.6 and 5.8 mm (corresponding to a strain range of 0.7 to 1.32%). The average deflection and corresponding strain values were 4.2 mm and 1.8%; the lower average transformation temperature was 107° C., while the upper was 150° C. The width of the hysteresis loop was 43° C.

Working Example III:

A torsion rod having the same composition as that of Example I was treated and tested in a corresponding manner. The rod had a round cross-section, with a diameter of 3 mm and a gauge length of 24 mm. It was first solution treated at 850° C. for 10 minutes, and then quenched into cold water. The rod was heated to 100° C., and twisted at this temperature through an angle of 80 degrees (measured with respect to the ends of the gauge length). This corresponds to a pitch angle of approximately 5 degrees, or an outer fiber strain of 6%. The rod was fixed in this strained condition, heated to a temperature of 300° C., and held for 20 minutes. The rod was then unloaded and slowly cooled to room temperature. Subsequently, a two-way effect in torsion was measured by cycling through a temperature range between 0° C. and 250° C. The reversible angular difference of the cross-sections at the ends of the gauge length was measured as 9 degrees, corresponding to a gradient angle of 34 minutes. The equivalent strains in the two principle directions (tension and compression) were 0.7%.

Working Example IV:

A tension rod having the same composition as that of Example I was treated and tested in a corresponding manner. The rod had the same dimensions as the torsion rod of Example III. It was first solution treated at a temperature of 850° C. for 15 minutes, and subsequently quenched into cold water. The rod was then strained at room temperature 4.0% in tension parallel to its tensile axis. While maintaining the applied tensile load, the rod was heated to 300° C. and held at this temperature for 20 minutes. The load was then released and the rod slowly cooled to room temperature. Several specimens were measured with two-way effects of 0.2 to 0.5% in the temperature range from 0°–200° C. A Martensite Stabilization Treatment according to Step 10 in FIG. II would have further improved the two-way effect and reduced the scatter.

The above examples are but a few of the possible applications of the invention. In principle, any alloy of the $\beta$-brass type naturally exhibiting (after conventional treatment) a significant one-way memory effect, and an unsatisfactory two-way effect, can be treated according to the process described herein to show a noticably improved two-way effect, suitable for practical applications. The Cu-Al-Ni and Cu-Al alloys are particularly conducive to this treatment.

We claim:

1. A process of producing and stabilizing a reversible two-way shape memory effect in a Cu-Al-Ni or a Cu-Al alloy, which comprises:

(1) solution treating a cast or powder metallurgically produced alloy in the temperature range of the $\beta$-solid solution;

(2) quenching the solution treated alloy in water;

(3) deforming said quenched alloy at a temperature below 300° C.; and (4) subjecting said deformed alloy to a shape stabilization treatment comprising:

(i) heat treating said deformed alloy at a temperature in the range between 150°–425° C. for 0.5 to 180 minutes concomitantly with an externally applied load, thereby producing a tensile, compressive or torsional strain on the alloy of at least 1.0%;

(ii) cooling the heat treated alloy; and (iii) releasing the cooled alloy from its externally applied load.

2. The process of claim 1, which further comprises subjecting said shape utilized alloy to a Martensite stabilization treatment comprising: heat treating said alloy within the temperature range of 200°–400° C. for 1 minute to 4 hours; and allowing said heated alloy to slowly cool to room temperature.

3. The process of claim 2, wherein the Martensite stabilized alloy is stabilized at the zero position of the two-way shape memory effect by a treatment comprising subjecting the stabilized alloy to a temperature which is the same temperature as the maximum expected service temperature for at least 1 minute; and then slowly cooling the heated alloy to room temperature.

* * * * *